United States Patent [19]

Feroldi

[11] Patent Number: 4,492,565

[45] Date of Patent: Jan. 8, 1985

[54] METHOD FOR ELIMINATING THE SKID MARKS FROM WORKPIECES HEATED IN WALKING BEAM FURNACES AND WALKING BEAM FURNACE FOR PERFORMING THE SAID METHOD

[75] Inventor: Bruno Feroldi, Genoa, Italy

[73] Assignee: Italimpianti Societa Italiana Impianti P.A., Italy

[21] Appl. No.: 457,251

[22] Filed: Jan. 11, 1983

[30] Foreign Application Priority Data

Jan. 22, 1982 [IT] Italy ..... 12413 A/82

[51] Int. Cl.[3] ..... F27D 3/00; F27D 3/04; F27B 9/14

[52] U.S. Cl. ..... 432/11; 432/122; 432/127

[58] Field of Search ..... 432/11, 122, 127

[56] References Cited

U.S. PATENT DOCUMENTS

| | | | |
|---|---|---|---|
| 729,540 | 6/1903 | Carroll | 432/127 |
| 2,325,757 | 8/1943 | Ehlers | 432/122 |
| 2,858,122 | 10/1958 | MacGregor | 432/11 |
| 4,025,298 | 5/1977 | Tokitsu | 432/122 |

FOREIGN PATENT DOCUMENTS

| | | | |
|---|---|---|---|
| 1206789 | 2/1960 | France | 432/122 |

*Primary Examiner*—John J. Camby

*Attorney, Agent, or Firm*—Berman, Aisenberg & Platt

[57] ABSTRACT

This invention relates to the walking beam furnaces—particularly of the bilateral-heating type, with fixed and/or walking beams (1, 2) cooled by means of water or other fluid—for the heating of metallurgical products (B), such as billets, blooms or the like. The invention aims to eliminate or minimize the localized cooling effect on metallurgical products where they contact the cooled beams, which cooling generates the so-called skid marks on said metallurgical products.

For this purpose, the invention provides a method wherein each metallurgical article is turned over 180° at least once around its longitudinal axis at a region in the furnace which is near the discharge end (18) of the furnace.

The invention also relates to a walking beam furnace wherein the above method can be carried into effect, characterized in that at a region in the furnace near the end (18) thereof, the fixed and/or walking beams (1, 2) comprise a longitudinal stretch having an upper toothed overturning profile (13, 14) capable of causing, during a few advancing steps, a 180° overturning of each metallurgical article around the longitudinal axis thereof.

11 Claims, 5 Drawing Figures

METHOD FOR ELIMINATING THE SKID MARKS FROM WORKPIECES HEATED IN WALKING BEAM FURNACES AND WALKING BEAM FURNACE FOR PERFORMING THE SAID METHOD

SUMMARY OF THE INVENTION

This invention relates to the walking beam furnaces for heating metallurgical articles, such as billets, blooms, or the like.

In the furnaces of this type, the oncoming articles are advanced step-by-step, whereby the lower side thereof rests alternately on the fixed and on the walking beams. As a consequence, and particularly in the bilateral-heating furnaces, where the beams are cooled by means of water or other fluid and, therefore, are relatively cool, the regions where the articles rest on the beams will be, upon discharge from the furnace (due to their contact with the beams and to the shielding from the burners) at a lower temperature than the average of the remaining portion of the article, thus generating the so-called skid marks. The latter are cooler regions and cause drawbacks during the milling of the articles, such as thickness variations in the flat-rolled sections and in the seamless tubes.

At present, in order to limit the drawbacks caused by said localized cooling of the metallurgical products on the cooled beams of the walking beam furnaces of the type specified above, mutually-spaced supporting members made of a special cobalt alloy are used, and the metallurgical articles in the furnace are supported by said supporting members. Such supporting members act as spacers between the cooled beams and the heated articles and, by virtue of the special alloy they are made of, they can reach, on their faces contacting the supported articles, temperatures much higher than said cooled beams while maintaining optimum mechanical characteristics at these high temperatures, such as to avoid any upsetting due to the weight of the articles. However, these supporting spacers have shown to be unsatisfactory to avoid said localized cooling zones, whereby the temperature of these zones at the outlet from the furnace is, notwithstanding said spacers, still considerably lower than the average temperature of the heated articles.

The invention, therefore, aims to further minimize the drawback of the localized cooling of the metallurgical articles (billets, blooms, and the like) being heated in the walking beam furnaces, particularly of the cooled beams type, due to the contact between said articles and said cooled beams, by reducing the amount of said cooling to virtually negligible levels.

For this purpose, the invention provides a method of heating metallurgical articles inside walking beam furnaces, substantially characterized in that each metallurgical article is turned over 180° at least once around its longitudinal axis at a region in the furnace which is near the discharge end of the furnace.

The invention also provides a walking beam furnace for carrying said method into effect, characterized in that at a region in the furnace which is near the discharge end thereof, the fixed and/or walking beams comprise a longitudinal stretch having a toothed overturning profile capable of causing, during a few advancing steps, a 180° overturning of each article around its longitudinal axis. According to the invention, therefore, the lower side of each article, contacting the beams or the supporting spacers on the beams and, therefore, locally cooled at the contacting regions, will be facing upwards after the 180° overturning of each article, for example due to the action of the overturning profile of said beams, and will be located on the opposite side from the source of cooling constituted by the beams and away from the shielded region generated by said beams. The longitudinal stretch of the beams having the toothed overturning profile terminates at such a distance from the outlet of the furnace, that each overturned article remains further in the furnace for a time period which is sufficient to equalize the temperature on the formerly-lower and presently-upper side thereof, that is to either eliminate or substantially reduce the temperature differences between the locally cooled zones (skid marks) and the remaining average temperature of the article. Thus, the drawbacks originating the localized cooling of the metallurgical articles at the contacting zons with the cooled beams are avoided or minimized. In addition to this main advantage, the invention also permits to reduce the length of the region of the furnace which is intended to equalize the temperature of the heated articles and, therefore, to reduce the overall length of the furnace for a same output and quality of the heat treatment (temperature uniformity) of the metallurgical heated articles, or it permits to obtain, with a same furnace length, improved quality characteristics of the heated articles.

As stated above, the invention is utilized particularly in the walking beam furnaces with at least a bilateral heating section, in which the beams are cooled by means of water or other fluid. The toothed overturning profile may be constructionally obtained in any suitable manner, for example by either giving the beams this configuration or mounting thereon suitably-shaped overturning members made of a special alloy and/or suitably cooled. The toothed overturning profile may be used in combination with the said supporting spacers arranged on the remaining stretches of the beams, and also in combination with beams not provided with said supporting spacers. The overturning toothed profile of the fixed and walking beams may have any suitable configuration, provided it causes a reliable and progressive 180° overturning of the heated articles, preferably in two or more (for example, four) advancing steps thereof.

BRIEF DESCRIPTION OF THE DRAWINGS

These and other features of the invention and the advantages resulting therefrom will be more apparent from the following description of a preferred embodiment thereof, shown in the accompanying drawings. In the drawings.

DESCRIPTION OF THE PREFERRED EMBODIMENT

Figure 1:
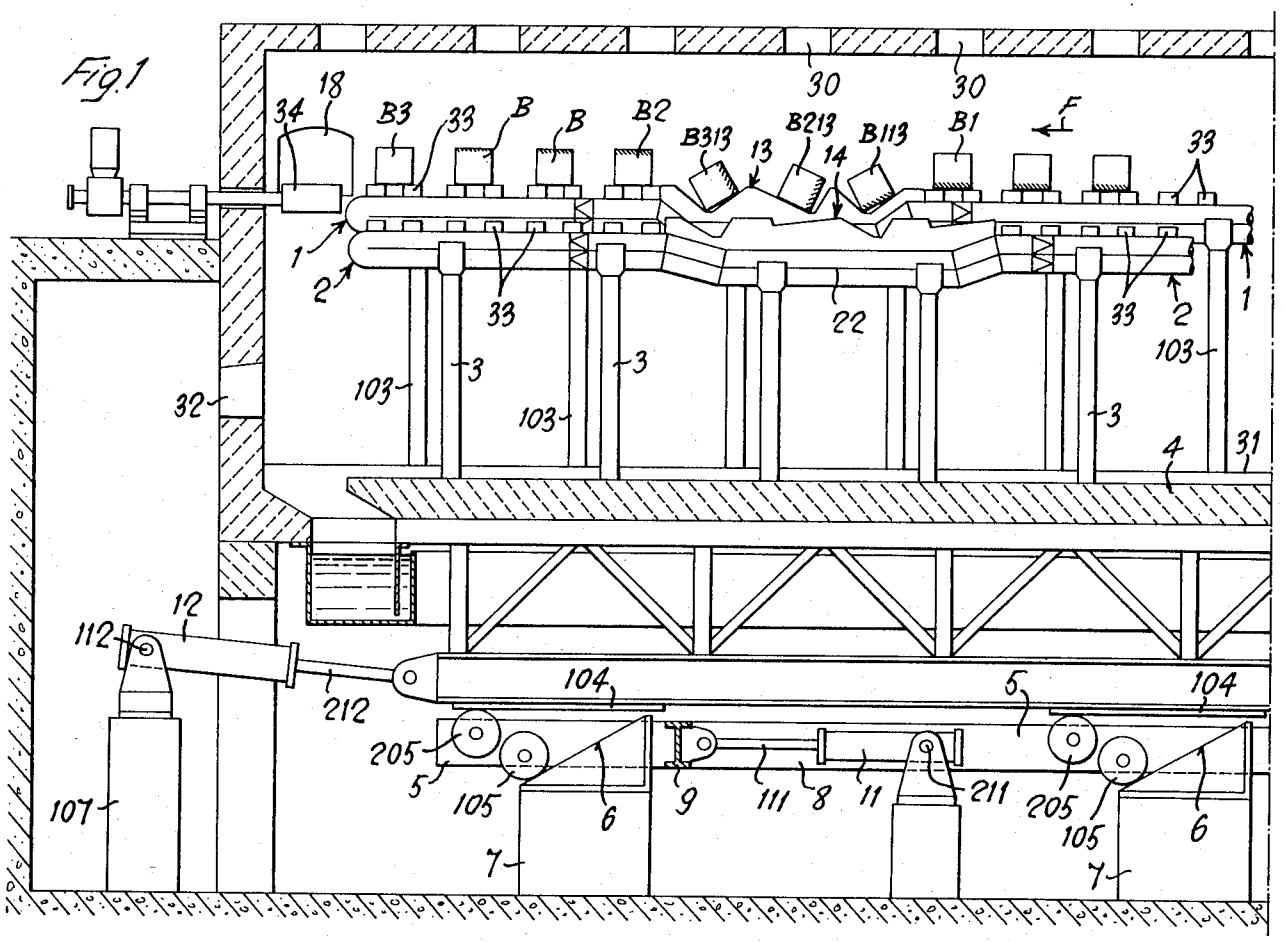
FIG. 1 is a diagrammatic, longitudinal, vertical sectional view of the end portion of a walking beam furnace according to the invention, with cooled beams.

The drawings show a walking beam furnace for billets, blooms and the like. This furnace will be described hereinafter by way of non-limiting example as used for heating metallurgical blooms, but it can also be used with billets or any other similar products.

In the drawings, reference numeral 1 indicates the fixed beams, and 2 the walking beams of the furnace. At least at the end portion of the furnace, both the fixed beams 1 and walking beams 2 are of tubular construction and are cooled in a conventional manner by circulating water or other fluid therethrough. The walking beams 2 may be lifted and lowered so as to assume, alternately, an upper position (FIGS. 2 and 3), wherein they protrude upwards from the support surface defined by the fixed beams 1 and they carry the blooms B, and a lower position (FIGS. 1 and 4), wherein they are lowered beneath the support surface defined by the fixed beams 1 and lay down the blooms B onto the fixed beams 1. Moreover, the walking beams 2 may be moved back and forth horizontally in their longitudinal direction. In the illustrated embodiment, these two possible movements of the walking beams 2 are obtained as follows:

The walking beams 2 are supported by tubular uprights 3, also cooled by means of water or any other fluid, fixed to a movable bottom platform 4 resting, through carriages 5, on stationary ramps 6 fixed to respective foundation blocks 7. The carriages 5 are connected to each other by means of longitudinal bars 8 that are pivoted, through a cross-member 9, to the piston rod 111 of a hydraulic cylinder 11 pivoted at 211. The carriages 5 are supported on the ramps 6 by rolling wheels 105 and are also provided with supporting freely-rotatable wheels 205 on which the platform 4 is slidably supported through the intermediary of lower longitudinal rails 104. The vertical lifting and lowering movement of the walking beams 2 is obtained by moving the carriages 5 horizontally by means of the hydraulic cylinder 11 on the respective ramps 6. The horizontal longitudinal back-and-forth movement of the walking beams 2, instead, is obtained by means of another hydraulic cylinder 12 which is pivotably mounted on a shaft 112 in a supporting stand 107 secured to the foundation, and which has a piston rod 212 pivotably connected to the platform 4.

The fixed beams 1 are likewise supported by tubular stationary uprights 103 which are cooled by means of water or other fluid and which are secured, for example, to the bottom hearth 31 of the furnace. Burners 30, 32 are provided above and below the beams 1, 2 so as to obtain a bilateral heating of the blooms B.

The lower burners 32 may be arranged, as shown, in the front wall of the furnace, and/or in the side walls of the furnace. The blooms B are carried by the beams 1 and 2 through the intermediary of mutually-spaced blocks 33, called supporting spacers, which are secured to the beams 1, 2 and are made, for example, of a special cobalt alloy.

The discharge side of the furnace is provided with a track comprising powered rollers 34, and the walking beams 2 may be inserted between these rollers so as to deliver the blooms B onto the powered rollers 34. This roller-track is transverse to the beams 1, 2 and conveys the heated blooms B out through a side discharge door 18. Obviously, this discharge track is not limitative of the invention, as other alternative discharge means may be provided. Thus, for example, as disclosed in other patents of the same applicant, the furnace may be provided, at the discharge end thereof, with a collecting internal hearth and with an axial discharging pusher. The furnace may be also provided with a front discharging apparatus picking up the articles from the beams and delivering them onto a roller track outside the furnace.

At the end region of the furnace, at a certain distance from the discharge roller-track, the fixed beams 1 present an upper toothed overturning profile 13 and the walking beams 2 are also provided with an upper toothed overturning profile 14. These overturning profiles 13, 14 are formed in respective insert members 23, 24 which are secured to the fixed beams 1 and walking beams 2 at depressed portions 21 and 22 of the beams 1 and 2, respectively. The insert profile members may be made, for example, of a suitable special alloy having a sufficient mechanical strength at the discharge temperature of the blooms B, such as a cobalt alloy, and/or they can be cooled by any suitable means, such as water or other fluid.

Figure 5:
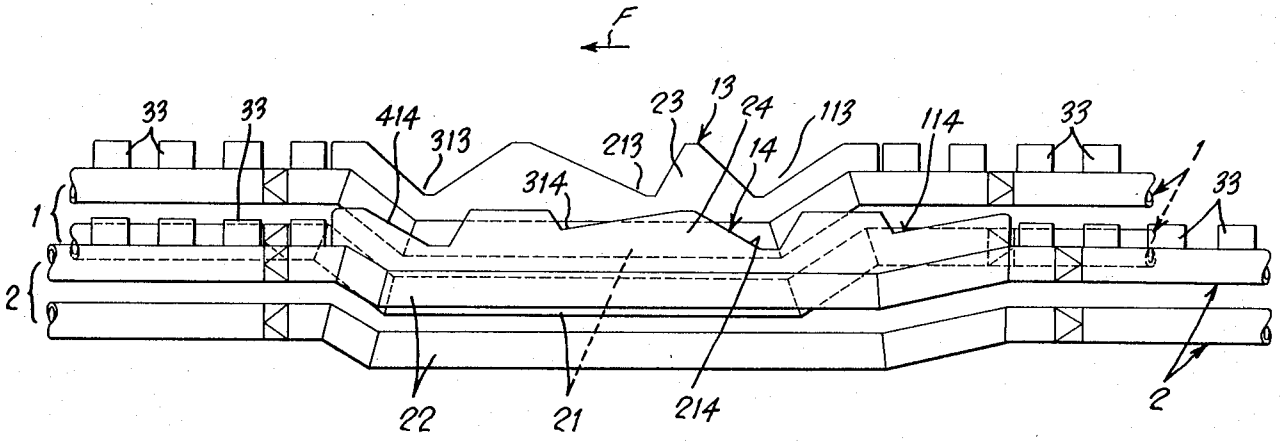
FIG. 5 is an enlarged elevational view of the toothed overturning profiles of the fixed and walking beams.

In the illustrated example, the toothed overturning profile 13 of the fixed beams 1 presents—related with the positions of the individual blooms B and with reference to the advancing direction F of the billets B along the furnace—three successive V-shaped seats 113, 213, 313 for said billets. The two sides of the first and third V-shaped seats 113, 313 have substantially the same inclination, or the side of these V-shaped seats 113, 313 which is nearer the discharge door 18 is slightly steeper than the opposite side, as shown particularly in FIG. 5. On the other hand, the overturning profile 14 of the walking beams 2 presents four successive seats 114, 214, 314, 414 for the billets, as shown particularly in FIG. 5. The second and fourth seats 214 and 414, with respect to the advancing direction F, are formed by V-shaped seats in which the side which is nearer the discharge door 18 is less steep than the opposite side. The first and third seats 114 and 314 are formed, instead, by inclined planes slightly sloping in the advancing direction F.

In the FIGS. 1 to 4, the seats of the overturning profiles 13 and 14 for the blooms are not indicated by their reference numerals. However, the blooms in said seats of the overturning profiles 13, 14 are indicated by the letter B followed by the numeral relating to the respective seat.

The depressed portions 21, 22 of the fixed and walking beams 1 and 2, respectively, under the overturning profiles 13, 14 may be integral with the remaining portions of the respective beams, or they may be fitted, if desired, in place of a corresponding previous straight portion of the beams 1 and 2. The insert depressed portions 21, 22 of the beams 1, 2 may have either the same configuration as, or a different configuration from, the beams 1 and 2.

In FIG. 1, the numeral B1 indicates a bloom resting on the supporting spacers 33 on the fixed beams in the position just preceding the respective overturning profile 13. This bloom B1 presents at the bottom side thereof, in registry with each fixed and walking beam 1 and 2, an area which is at a lower temperature than the average temperature of the remaining portion of the bloom. These locally cooler areas, shown by hatching in FIG. 1, can originate transverse skid marks on the bottom side of the bloom and are due to the contact with the supporting spacers 33 cooled by the beams 1, 2 and to the shielding (shadow zone) with respect to the lower burners 32.

Figure 2:
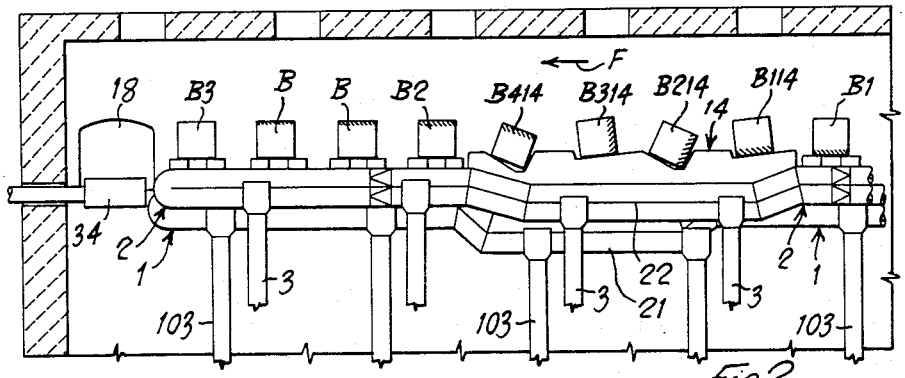
FIGS. 2 to 4 are sectional views similar to FIG. 1, of the discharge end portion of the furnace, showing three successive positions, respectively, of the walking beams in the advancing cycle.
Figure 3:
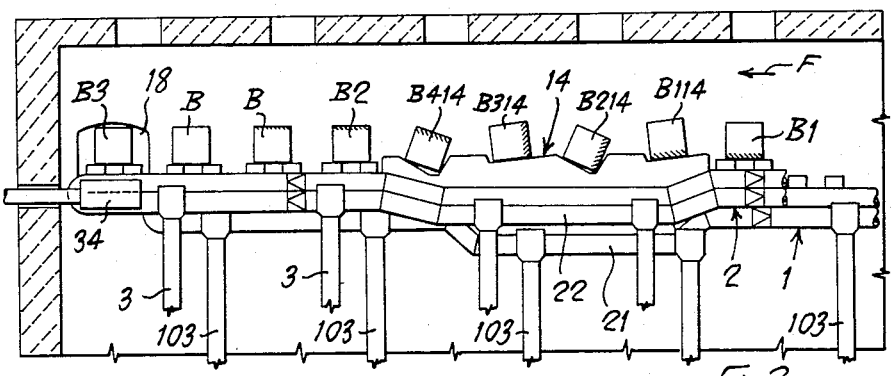
Figure 4:
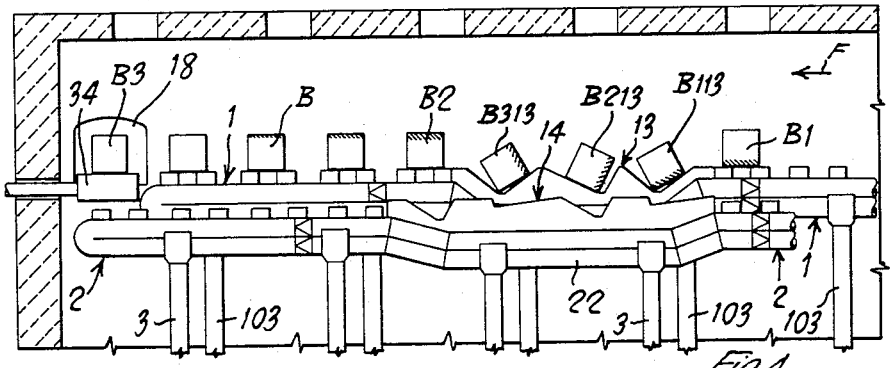

In FIG. 1, the walking beams 2 are in their lower position, retracted towards the inlet end of the furnace. From this position, the walking beams 2 are lifted and are thus enabled to pick up the blooms B, including the bloom B1, from the fixed beams 1, as shown in FIG. 2. The bloom 1 will be positioned on the first seat 114, having a slightly inclined plane, of the overturning profile 14 of the walking beams 2, where it is indicated by B114, and will assume an inclined position at a certain angle with respect to its original position, as shown in FIG. 2. The lifted walking beams 2 are then moved forwards in the direction of the arrow F towards the discharge end of the furnace, whereby the blooms resting on said walking beams 2 (FIG. 3) will be advanced one step. In this position, the bloom 114 will be above the first seat 113 of the overturning profile 13 of the fixed beams 1. The walking beams 2 are then lowered to lay down the bloom B114 into the V-shaped seat 113 of the fixed beams 1, so that this bloom, now indicated by 113, assumes an inclined position that is rotated by a further angle from the preceding position B1 on the fixed beams, as shown in FIG. 4. Finally, the thus lowered walking beams 2 are moved back towards the inlet end of the furnace again to the original position shown in FIG. 1.

At the subsequent cycle of movements of the walking beams 2, the bloom B113 located in the V-shaped seat 113 of the overturning profile 13 of the fixed beams 1 is first picked up by the walking beams 2 by means of their V-shaped seat 214, where it assumes the position B214 (FIG. 2) and is thus further rotated by a certain angle from the position B113. Thereafter, this bloom B214 is laid down by the walking beams 2 into the V-shaped seat 213 of the overturning profile 13 of the fixed beams 1 and assumes the position shown by B213 in FIG. 4. In this position, the bloom B213 is rotated about 100° from the original position B1. The face having the skid marks on the bloom B213 is now on the back side of said bloom.

Upon the third cycle of movements of the walking beams 2, the bloom B213 located in the V-shaped seat 213 of the overturning profile 13 of the fixed beams 1, is picked up by the walking beams 2 by means of the slightly inclined seat 314 of their overturning profile 14, wherein it assumes a position which is inclined at an angle of over 100° from the original position B1, as clearly shown in FIG. 2. Thereafter, the bloom B314 is laid down by the walking beams 2 into the V-shaped seat 313 of the overturning profile 13 of the fixed beams 1, where it assumes the position indicated by B313 in FIG. 4, further rotated of a certain angle. The bloom B313 is then rotated by little less than 180° from its original position B1.

In the fourth cycle of movements of the walking beams 2, the bloom B313 located in the V-shaped seat 313 of the overturning profile 13 of the fixed beams 1, is picked up by the walking beams 2 by means of the V-shaped seat 414 of their overturning profile 14, where it assumes the position B414 (FIG. 2) and is further rotated forwards.

The bloom B414 is now rotated of nearly 180° around its longitudinal axis from the position B1 upstream of the overturning profile 13 of the fixed beams 1. The bloom B414 is finally laid down by the walking beams 2 onto the supporting spacers 33 of the fixed beams downstream of the overturning profile 13 of the fixed beams 1, in a position B2 shown specifically in FIG. 4 and wherein the bloom is turned over 180° from the original position B1 upstream of the overturning profiles 13, 14 of the beams. In this position B2, the face of the bloom having the skid marks is on the horizontal upper side of the bloom.

The blooms are then advanced, in this new position B2, by a number of steps for a time period sufficient to equalize the temperature on the face thereof having the localized cooling zones (skid marks), formerly at the bottom and now on the top, whereby said cooler zones are substantially eliminated when the blooms reach the discharge region, for example the powered rollers discharge track. Upon each cycle of movements of the walking beams 2, the latter lay down a bloom B3 onto the powered roller track 34 whereby such a bloom is discharged through the side discharge door 18 (FIGS. 3 and 4).

Of course, the invention is not limited to the embodiment here shown and described, but broad changes and modifications can be made thereto, particularly of constructional nature, and concerning the functional and technical equivalents. Thus, for example, such changes may concern the number of advancing steps required to turn over 180° a bloom around its longitudinal axis by the action of the overturning profiles of the fixed and walking beams.

The configurations of the two cooperating overturning profiles of the fixed and walking beams may also be changed, and changes may also be made to the actuating means for the walking beams and to the other constructional and functional characteristics of the furnaces to which the invention is applied. In particular, the invention may also be used with furnaces in which the beams are not provided with said supporting spacers, i.e. wherein the metallurgical articles, such as blooms, billets and the like are supported on the beams directly.

I claim:

1. A method of elliminating or minimizing the effect of localized cooling on metallurgical articles (B) due to contact with cooled fixed and/or walking beams (1, 2) in a walking beam furnace for heating metalurgical articles (B), such as billets, blooms and the like, characterized by turning each metallurgical article over 180° around its longitudinal axis at least once at a region within the furnace and near the discharge end (18) thereof and thereafter maintaining the metallurgical articles in the furnace for a period of time sufficient to eliminate or substantially reduce areas of such localized cooling.

2. In a process wherein skid marks are formed on metallurgical articles by contact with cooled fixed and/or walking beams while being heated in a walking beam furnace, the improvement which comprises a combination of turning the metallurgical articles and thereafter exposing the skid marks thereon to sufficient heat for a sufficient period of time to reduce said skid marks substantially or to remove them entirely.

3. In a walking beam furnace having a discharge end and wherein metallurgical articles processed therethrough have areas of localized coolling while being advanced toward the discharge end, the improvement wherein the furnace comprises (a) turning means therewithin and near said discharge end to turn each such mettalurgical article over 180° around its longitudinal axis at least once after such areas of localized cooling are formed and (b) means downstream from the turning means to advance said metallurgical articles within the furnace at a sufficient temperature and for a sufficient period to eliminate or substantially reduce said areas of localized cooling.

4. A walking beam furnace according to claim 3 of the bilateral-heating type with fixed and/or walking beams (1, 2) cooled by means of water or other fluid.

5. A walking beam furnace according to claim 4 wherein the fixed and/or walking beams (1, 2) present an upper toothed overturning profile (13, 14) along a longitudinal stretch thereof as part of the turning means.

6. A walking beam furnace according to claim 5, characterized in that the longitudinal stretch of a beam having the overturning toothed profile (13, 14) terminates at such a distance from the outlet of the furnace, that each overturned article (B) remains in the furnace for a time period which is sufficient to equalize the temperature of its side which was at the bottom upstream of the overturning profile and which is at the top downstream of the overturning profile.

7. A walking beam furnace according to claim 5, characterized in that the overturning profile (13, 14) of the fixed and/or walking beams (1, 2) is obtained by shaping the upper side of the respective beams accordingly.

8. A walking beam furnace according to claim 5, characterized in that the overturning profile (13, 14) of the fixed and/or walking beams (1, 2) is formed in suitable overturning insert members, fitted on the beams and made of an alloy resisting to the temperature of the heated articles, and/or suitably cooled by means of water or other fluid.

9. A walking beam furnace according to claim 8, characterized in that the overturning profiles (13, 14) of the fixed and/or walking beams (1, 2) are provided on depressed stretches (21, 22) of the respective beams.

10. A walking beam furnace according to claim 5, characterized in that the overturning profiles (13, 14) of the fixed and walking beams (1, 2) cooperate with each other so as to cause the 180° overturning of the articles in four successive advancing steps thereof.

11. A walking beam furnace according to claim 10, characterized in that the overturning profile of each fixed beam (1) comprises three successive V-shaped seats (113, 213, 313) for the articles, while the overturning profile of each walking beam comprises four successive seats (114, 214, 314, 414) the second and the fourth of which are of V-shape and the first and the third of which comprise a slightly-inclined supporting plane.

* * * * *